United States Patent [19]

Thurman

[11] Patent Number: 4,538,302

[45] Date of Patent: Sep. 3, 1985

[54] SNAP CRAVET NECKTIE AND KNOT FORM

[76] Inventor: Truman D. Thurman, 3617 Tutwiler Ave., Memphis, Tenn. 38122

[21] Appl. No.: 659,180

[22] Filed: Oct. 9, 1984

[51] Int. Cl.[3] ..... A41D 25/14; A41D 25/08

[52] U.S. Cl. ..... 2/150; 2/153

[58] Field of Search ..... 2/144, 145, 146, 147, 2/148, 149, 150, 152 R, 152 A, 153, 156, 157; 206/282, 295, 296; 223/81, 82, 83

[56] References Cited

U.S. PATENT DOCUMENTS

| | | | |
|---|---|---|---|
| 2,463,320 | 3/1949 | Schwartz | 2/146 |
| 2,473,739 | 6/1949 | Wade | 2/150 |
| 2,843,850 | 7/1958 | Thurman | 2/148 |
| 2,990,551 | 7/1961 | Schreter et al. | 2/145 |
| 3,890,678 | 6/1975 | Leonard, Jr. | 2/153 |
| 4,000,523 | 1/1977 | Woods | 2/153 |

*Primary Examiner*—Louis K. Rimrodt

*Assistant Examiner*—Joseph S. Machuga

*Attorney, Agent, or Firm*—John J. Mulrooney

[57] ABSTRACT

A one-piece, neck-encircling long necktie having a know form and snap means comprising a single piece of synthetic perma-press, one-way stretchable fabric having a single seam centered in the backside of the tie and having its ends formed from three-layer folds to provide a semi-pointed shape and including a knot form positioned approximately midway in said tie comprising a molded, flexible single member having an upper flap with a longitudinal groove therein separated from a mid-portion by a fold line of reduced thickness, a middle portion extends downwardly and outwardly from said fold line to a transverse groove, and a lower part portion extending downwardly from said transverse groove and holes for attaching snap means therein and a lower rounded edge.

1 Claim, 6 Drawing Figures

FIG. 1

SNAP CRAVET NECKTIE AND KNOT FORM

BACKGROUND OF THE INVENTION

1. Field of the Invention

The present invention relates to a necktie and, more particularly, to a one-piece, hand-looped long neck-encircling necktie including a knot form and snap means.

2. Description of the Prior Art

The use of neckties having knot forms and snaps to facilitate the tying and improve the appearance of knots is known. See for example U.S. Pat. No. 2,843,850 which discloses a necktie form comprising a U-shaped body. The present invention combines a novel necktie construction and knot form which improves on prior neckties and knot forms.

SUMMARY OF THE INVENTION

A one-piece, hand-tied, neck-encircling long necktie having a knot form and snap means comprising a single piece of synthetic perma-press one-way stretchable fabric having a single seam centered in the backside of the tie and having its ends formed from three-layer folds to provide a semi-pointed shape and including a knot form positioned approximately midway in said tie comprising a molded, flexible single member having an upper flap with a longitudinal groove therein separated from a mid-portion by a fold line of reduced thickness, a middle portion extends downwardly and outwardly from said fold line to a transverse groove, and a lower flap portion extending downwardly from said transverse groove and holes for attaching snap means therein and a lower rounded edge and has a pair of holes for snap means and a lower semi-circular edge shape.

DESCRIPTION OF THE PREFERRED EMBODIMENT

Figure 1:
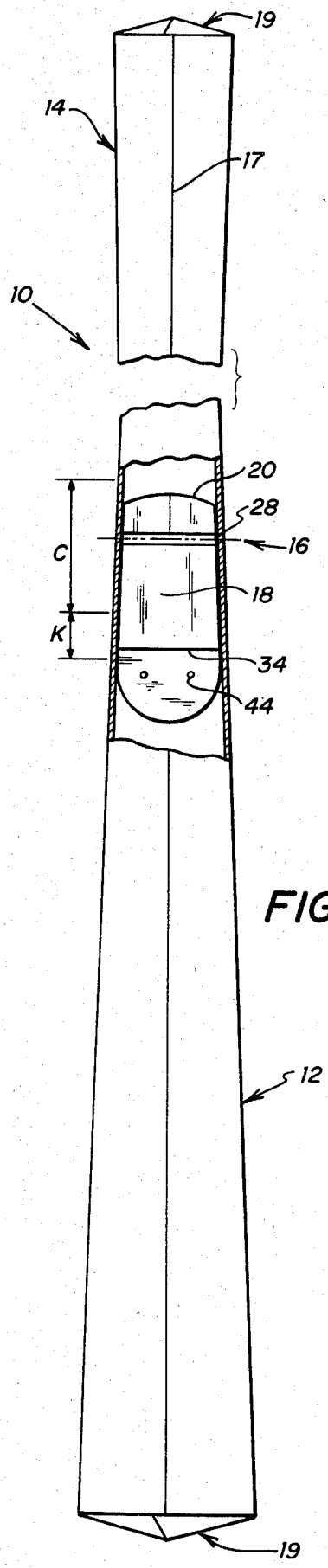
FIG. 1 is a bottom plan view of a necktie according to the present invention as it appears before application to the neck of the wearer.

Referring to the drawings, a necktie 10 according to the present invention may be considered as comprising a front panel 12 and a back panel 14 separated by an imaginary center line 16 which divides the tie evenly into the front panel and back panel. As usual, the front panel is somewhat wider than the back panel, and further in accordance with conventional practice, the tie is of the type tubularly formed and constructed from end to end from a single piece of fabric as more particularly hereinafter described. The tie has a collar measurement indicated by the distance C and a knot measurement indicated by the distance K in FIG. 1.

Figure 6:
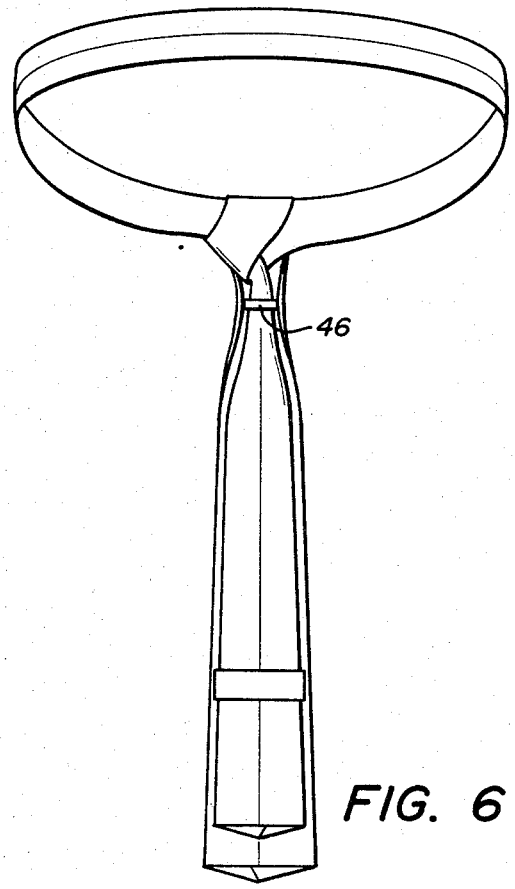
FIG. 6 is a fragmentary rear elevational view of the necktie of the present invention in its knotted condition.

Only synthetic, permanent press, one-way stretchable fabric is used in the manufacture of ties according to the present invention. A single tie seam 17 is located at the center at the backside of the tie pattern (FIG. 6) which is cut across, or transverse to the longitudinal direction of, the fabric bolt using well-known pinking shears having a zigzag cutting edge. After manufacture, the singular tubular construction is turned inside out whereby the edges of the cut fabric are not visible. Each end of the tie is formed according to a three-layer fold to have a semi-pointed appearance 19 (FIG. 1). The ends of the necktie of the present invention are semi-pointed as contrasted with sharp-pointed ends of the prior art. See U.S. Pat. No. 2,843,850. The semi-pointed appearance is obtained by inverting or tucking a small length of the fabric into the tubular form and folding the inverted end fabric to make the semi-pointed shape as illustrated in FIG. 1.

Figure 2:
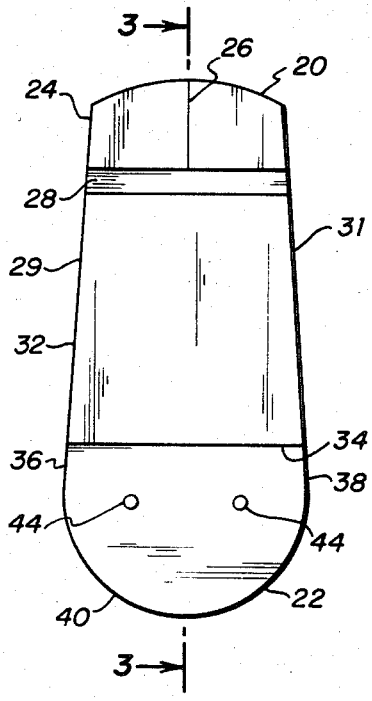
FIG. 2 is a front elevational view of the knot form.
Figure 3:
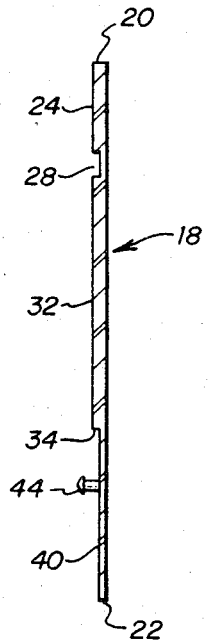
FIG. 3 is a longitudinal sectional view of the knot form taken on line 3—3 of FIG. 2.

The knot form 18 of the present invention is shown superimposed on the tie in FIG. 1 and is more particularly illustrated in FIGS. 2 and 3. The form 18 comprises a single piece of molded, flexible material which is shaped to extend from an upper rounded edge 20 downwardly and outwardly to a bottom, semi-circularly shaped edge 22.

The form has an upper flap 24 having a longitudinal groove, or bend line 26 therein. The groove 26 facilitates and insures that the knot form will bend along the longitudinal center thereof to provide a symmetrical appearance. A fold line of reduced thickness in the form of a transverse groove 28 separates flap 24 from a middle section 32. Fold line 28 extends entirely across the form acts as a guide when flexing over the front panel to make the simulated knot as hereinafter described.

The fold line 28 defines the line at which upper flap 24 will be folded backward. The fold line 28 locates the top edge of the knot and insures the repeatability of the knot on each occasion it is tied. The thinner design (FIG. 2) of the knot form 18 at the fold line 28 eliminates a bulky appearance at the fold line that would occur if the fold line 28 was the same thickness as upper flap 24 and middle portion 32. Also, the fold line 28 locates the position in the tie where the knot will be located.

Figure 5:
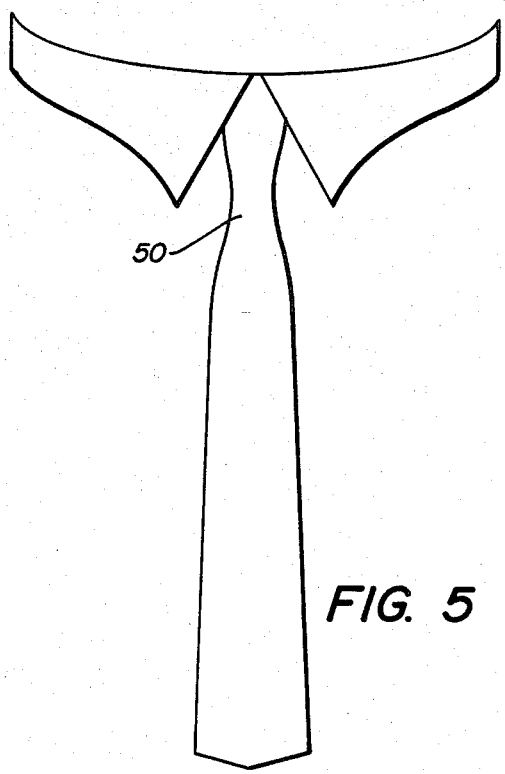
FIG. 5 is a fragmentary front elevational view of the necktie of the present invention in a knotted condition.

Form 18 has a middle section 32 which extends downwardly and outwardly from the fold line 28 to a lower, transverse groove 34. The transverse groove 34 delineates a change in thickness (FIG. 3) from middle portion 32 to lower flap 40. The thinner section for lower flap 40 facilitates bending of the knot form and fastening of elements 44 and 46 to improve the simulated knot appearance at 50 (FIG. 5). Sides 29 and 31 of form 18 extend downwardly and outwardly at 36 and 38 below said transverse groove 34 to form a lower flap 40 having a circular edge 22.

Lower flap 40 has a pair of male gripper fastener elements 44, spaced apart transversely of the longitudinal center line of form 18. The elements 44 open upon the back face of the form, that is, the face behind the front panel of the tie. A double-ended female fastener element 46 (FIG. 6) has heads adapted to engage the male fastener elements 44. One of the male fastener elements 44 is slightly swelled to prevent the female extension 46 from easily coming off.

The necktie form is incorporated directly within the tubular body of the necktie as illustrated in FIG. 1. Only a single size of the necktie form is required for either boy's ties or men's ties because, by adjusting the position of the form depending on its application to a boy's tie or men's tie, a single size knot form is useful in either. The following schedule provides the measurements for location of the knot form in ties of various lengths wherein all measurements are in inches and the back and front panels are measured from the center line 16 to the ends of the tie, the collar measurement C (FIG. 1) is measured one-fourth on each side of the center line 16, the knot measurement K (FIG. 1) is measured from the end of the collar measurement C on the front panel side in the direction toward the end of the tie and the snap fastener 44 location is measured from the end of the back panel 14 toward the front panel 12 end:

| LENGTH OF BACK PANEL (INCHES) | Collar | Knot | Front Panel | Tie Length |
|---|---|---|---|---|
| 14½ + | 13½ + | ¾ + | 15 = | 43¾ |
| 15 + | 14 + | ¾ + | 15½ = | 45¼ |
| 15½ + | 14½ + | ¾ + | 16 = | 46¾ |
| 16 + | 15 + | ¾ + | 16½ = | 48¼ |
| 16½ + | 15½ + | ¾ + | 17 = | 49¾ |
| 17 + | 16 + | ¾ + | 17½ = | 51¼ |
| 17½ + | 16½ + | ¾ + | 18 = | 52¾ |
| 18 + | 17 + | ¾ + | 18½ = | 54¼ |
| 18½ + | 17½ + | ¾ + | 19 = | 55¾ |
| 19 + | 18 + | ¾ + | 19½ = | 57¼ |

Figure 4:
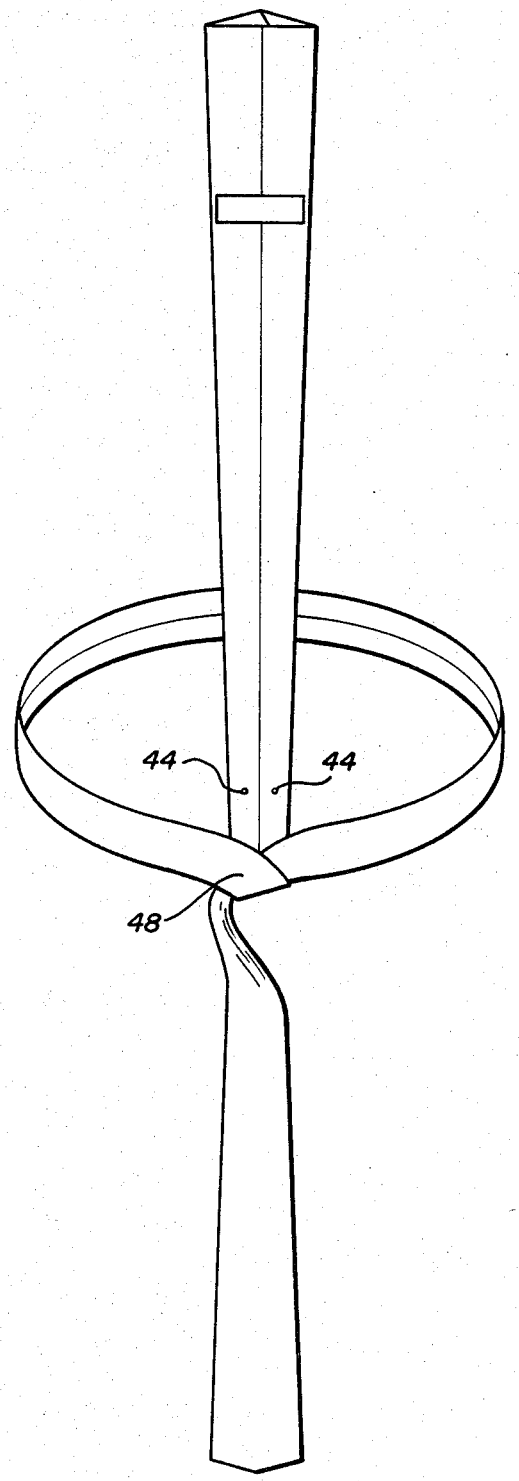
FIG. 4 is a view of the necktie during the initial step of knotting the same about the wearer's neck.

In use, a tie including a knot form according to the present invention, is extended around the collar and the front panel is then crossed over the back panel. Then, the front panel 10 (FIG. 4) is extended upwardly with its back surface at this stage of the operation facing outwardly from the wearer. The back panel 14 extends downwardly as shown in FIG. 4.

Then, the wearer flips the front panel 10 forwardly to its FIG. 5 position. In this connection, when the front panel 10 is flipped forwardly in this manner, the fold line 28 (FIG. 2) is registered with the top edge of the neck-encircling portion 48 (FIG. 4) of the necktie. The fold line 28 effectively locates the top edge of the knot and insures the repeatability of the knot on each occasion it is snap-tied.

After the front panel 10 is flipped forwardly, the back panel 14 is disposed between the male fastener elements 44, the middle and bottom portions of the form are flexed along the longitudinal center thereof to dispose fastener elements 44 in confronting relation, so that the female extension snap 46 may be engaged with the male elements 44. The form is so designed as to permit the necktie to be tied about the neck in a minimum amount of time and minimum ease, it being apparent that one need merely cross the portions of the tie as shown in FIG. 4; flip the front panel forwardly and connect the female snap element 46 between the male elements 44. It will be seen that there is thus defined a knot-simulating portion 50 (FIG. 5) of the necktie which will have an attractive symmetrical appearance imparted thereto due to the fact that the form 18, when folded along line 28 and bent longitudinally to allow fastening of snap elements 44 and 46, provides and attractive, symmetrical knot appearance.

The necktie is adapted to be tied either from the left or the right side, without modification or redesign. The knot form is adapted to be inserted during manufacture of the ties, and a single size fits all ties, whether of boy's sizes or men's sizes. Further, the ties can be made in different lengths to fit different shirt collar sizes and waist lengths, and this will insure the automatic proportioning of the two ends or panels of the tie each time the tie is tied. The above schedule provides the various measurements for ties having different lengths.

While this invention has been described in terms of an illustrative embodiment, this description is not intended to be construed in a limiting sense. It is, of course, understood that various modifications may be made by persons skilled in the art, and it is therefore contemplated that the appended claims will cover any such modifications as fall within the true scope of the invention.

I claim:

1. The combination of a long, neck-encircling, hand-tied necktie and a knot form within said necktie, said knot form comprising a flexible body shaped as to impart a simulation knot to said necktie when tied at the front of a wearer's neck, said knot form having a longitudinal shape which extends downwardly and outwardly from an upper flap, a middle section and a lower flap, said upper flap having a longitudinal groove therein and being separated from said middle portion by a fold line, a transverse groove separating said middle section from said lower flap, and said lower flap having male and female fastener means symmetrically disposed on either side of the longitudinal center line of the form for maintaining said simulated knot in an attractive symmetrical appearance and having a lower circular edge, said upper flap and said middle portion of said form having thickness which are approximately twice the thickness of said fold line and said lower flap.

* * * * *